United States Patent [19]

Squires

[11] Patent Number: 4,532,955

[45] Date of Patent: Aug. 6, 1985

[54] WEDGE LOCK VALVE RETAINER

[75] Inventor: V. Alan Squires, Grove City, Pa.

[73] Assignee: Cooper Industries, Inc., Houston, Tex.

[21] Appl. No.: 587,970

[22] Filed: Mar. 9, 1984

[51] Int. Cl.[3] ..... F16K 43/00

[52] U.S. Cl. ..... 137/15; 137/315; 137/454.2; 220/327; 220/378; 403/369

[58] Field of Search ..... 137/15, 315, 454.2, 137/454.5, 540.11; 220/327, 378; 403/369, 370, 374

[56] References Cited

U.S. PATENT DOCUMENTS

| | | | |
|---|---|---|---|
| 321,635 | 7/1885 | Palmer | 403/370 |
| 3,018,127 | 1/1962 | Dobrosielski et al. | 220/327 |
| 3,957,381 | 5/1976 | Schafer | 403/369 |
| 4,108,259 | 8/1978 | Dixon et al. | 403/369 |
| 4,268,185 | 5/1981 | Mullenberg | 403/370 |

FOREIGN PATENT DOCUMENTS

| | | | |
|---|---|---|---|
| 2352751 | 3/1974 | Fed. Rep. of Germany | 403/374 |
| 1571233 | 6/1969 | France | 220/327 |

*Primary Examiner*—George L. Walton
*Attorney, Agent, or Firm*—Wigman & Cohen

[57] ABSTRACT

The present invention relates to an arrangement for and method of retaining a compressor check valve assembly in a cylinder. Each one of a plurality of wedge segments includes an inner surface, an outer surface, and a tapered hole which passes through the wedge segment between the outer surface and a portion of the inner surface. A bolt passes through the tapered hole in the wedge segment and is received in a threaded bore means within the compressor check valve assembly. With this arrangement, the bolt may be used to draw the wedge segment between the check valve assembly and the interior surface of the cylinder so as to frictionally lock said valve assembly within the cylinder.

21 Claims, 5 Drawing Figures

WEDGE LOCK VALVE RETAINER

BACKGROUND OF THE INVENTION

This invention relates to wedge lock devices and, in particular, to wedge lock devices for retaining compressor check valve assemblies in place against high pressure loads and to a method of retaining a check valve assembly within a cylinder using wedge lock devices.

The prior art methods of retaining a compressor check valve assembly within a cylindrical bore are generally unsatisfactory. Conventionally, the check valve assembly is supported on a narrow annular ledge within the cylindrical bore and is secured tightly against such ledge by a valve cap assembly that is bolted to the cylinder wall and bears with substantial force upon the check valve assembly. Such arrangement causes high stresses to be directed onto the narrow ledge thereby sometimes causing deformation and cracking of the cylinder wall surrounding the ledge.

In addition, residual forces at the base of the valve cap assembly cause potentially damaging hoop stresses in the cylinder wall at the plane where the cylinder wall meets the base of the valve cap assembly.

In order to overcome this problem in the prior art, one solution has been to size the bolting of the valve cap to at least double the gas load requirements, while not exceeding a certain pre-stress torque value on the bolts. However, this solution has not been desirable in terms of the cost and amount of material used to satisfy these requirements.

Several devices are known in the prior art which comprise wedge-shaped devices to frictionally lock an object firmly in place. However, none have been specifically designed or utilized to secure a check valve assembly within a cylinder. Examples of the prior art wedge lock devices are found in U.S. Pat. Nos. 3,957,381; 3,918,779; 3,477,335; 3,122,159; 2,834,081; and 2,233,223. A review of the aforesaid references indicates that none of them teach devices that would be suitable for retaining a check valve assembly.

The prior art devices that utilize wedges for locking purposes are generally adapted for use in engaging a shaft within a collar or bearing, and comprise a complete, or almost complete, ring-shaped device. One problem resulting from such prior art devices is that the ring must be made to the specific size of the shaft being engaged, the result being that the prior art devices are not very versatile. Another problem associated with the ring-shaped design is that the device may jam if it is inserted at a slight angle.

Although the prior art retaining devices taught in U.S. Pat. No. 2,233,223 comprise wedge-shaped latching segments rather than rings, such segments do not utilize a true wedge action to achieve their intended purpose. Rather, the retaining action is provided by pivoting the latching segments so that the segments engage in a latching manner with the inside cylinder wall. Accordingly, the stress in the cylinder wall is substantial and is localized at the points where the segments engage the wall.

Thus, there is a need for a device to retain a check valve assembly within a cylinder without placing high stresses on the cylinder wall and/or the ledge upon which the check valve assembly is positioned.

SUMMARY AND OBJECTS OF THE INVENTION

In view of the foregoing limitations and shortcomings of the prior art devices, as well as other disadvantages not specifically mentioned above, it should be apparent that there still exists a need in the art for an effective means for retaining a compressor check valve assembly within a cylinder. It is therefore, a primary object of this invention to fulfill that need by providing a cooperative arrangement for effectively retaining a compressor check valve assembly within a cylinder.

More particularly, it is an object of this invention to provide a means for retaining a compressor check valve on a narrow annular ledge within a cylinder without placing high stresses on the ledge and the surrounding cylinder wall.

Yet another object of this invention is to provide a plurality of wedge segments adapted to position and lock a check valve assembly securely within a cylinder.

Briefly described, these and other objects are accomplished according to the invention by providing a plurality of wedge segments, each segment having at least one bore and a bolt extending through the bore and being threaded into a corresponding threaded hole in a compressor check valve assembly in such manner that a portion of each wedge segment is frictionally engaged with and locked between the compressor check valve assembly and the wall of the check valve cylinder. Each wedge segment also includes at least two threaded bores and jack bolts for removing the wedge segment from its frictional engagement between the compressor check valve assembly and the wall of the cylinder.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
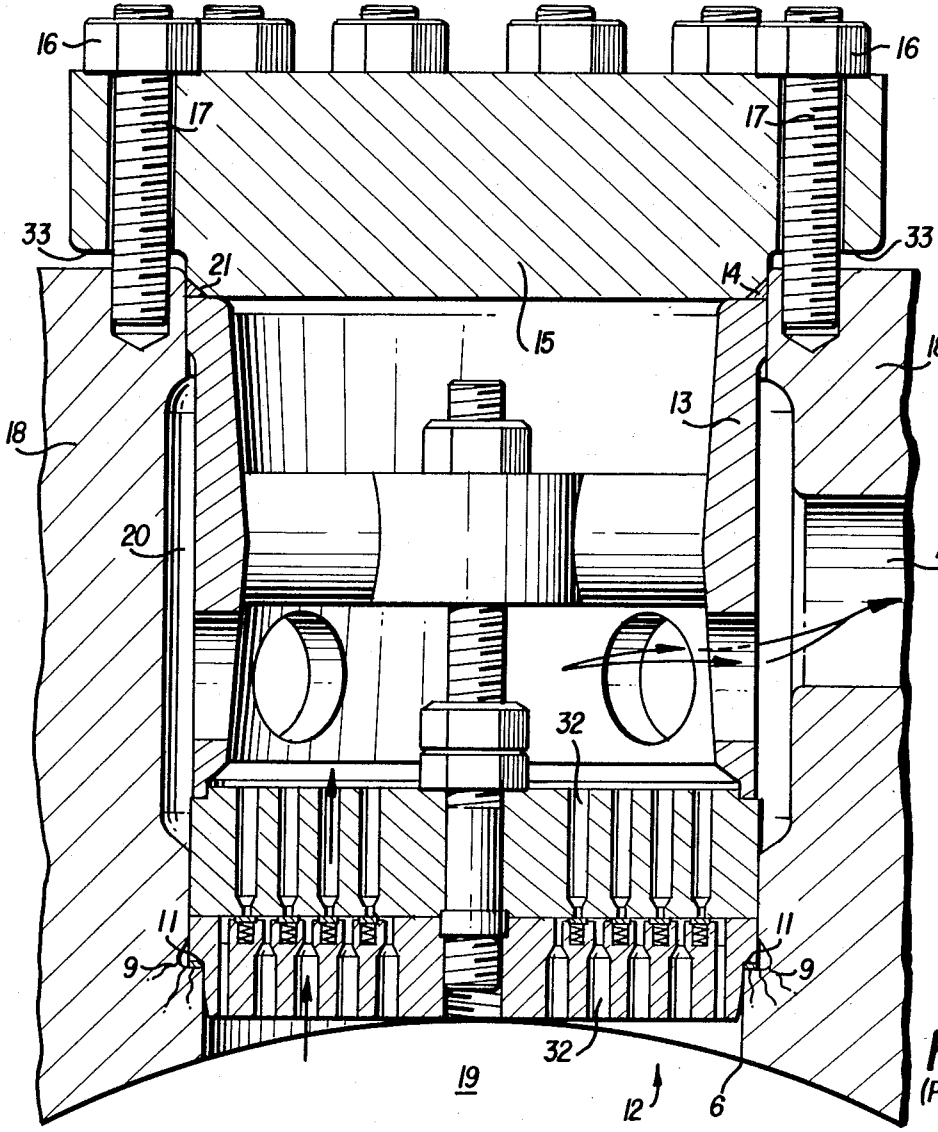
FIG. 1 (PRIOR ART)
FIG. 1 is a cross-sectional perspective view of a compressor check valve assembly, a cage, and a cap assembly of a prior art valve retainer in a cylinder shown partly broken.

Referring now in detail to the drawings wherein like parts are designated by like reference numerals throughout, there is illustrated in FIG. 1 a prior art means for assembling a check valve assembly 12 and a valve cap 15 to a cylinder wall 18. A flat metallic valve gasket 11 is seated upon a narrow annular ledge 9 formed in the cylinder wall 18, and the compressor check valve assembly 12 is placed on the valve gasket 11. A tubular cage 13 having a plurality of openings in the side walls thereof is seated on the upper peripheral edge of the valve assembly 12. A metallic gasket 14 having a round cross-section is placed upon the upper end of the cage 13 and is deformed between a 45° chamfered surface 21 on the valve cap 15, the cylinder wall 18 and the upper end of the cage 13. The valve cap 15 has a flange 33 which extends over and is spaced from the top of the cylinder wall 18. Studs 17 threaded into cylinder wall 18 extend upwardly through bores in the valve cap flange 33. Nuts 16 are threaded onto the studs 17 and torqued to a predetermined force.

The maximum load or force acting upwardly against the exposed bottom surface of the valve cap 15 depends upon both the working pressure of the compressor in cavity 19 and the diameter of the cylinder 20. The direction of gas flow from cavity 19 through bores 32 to outlet 22 during discharge is shown by arrows. The total bolting force must always exceed the total force exerted by the gas preferably by a factor of at least two in order to prevent the valve cap 15 from being blown off. Any bolting forces in excess of the gas force are exerted on top of the cap gasket 14, the cage 13, and the valve assembly 12.

The prior art design shown in FIG. 1 is unsatisfactory because it places undesirable stresses on the cylinder wall 18 in two locations. Because of the chamfered surface 21 of the valve cap 15, a portion of the bolting force creates a hoop stress in the cylinder wall 18 in the transverse plane at the point where the chamfered surface 21 confronts the cylinder wall 18. The remaining portion of the bolting forces is directed down through the cage 13, the check valve assembly 12, and the valve gasket 11 to the ledge 9 causing a shear stress in the wall 18 of the cylinder at this point. Substantial cylinder wall deformation and cracking can occur adjacent the ledge 9 because of such shear stresses.

Figure 3:
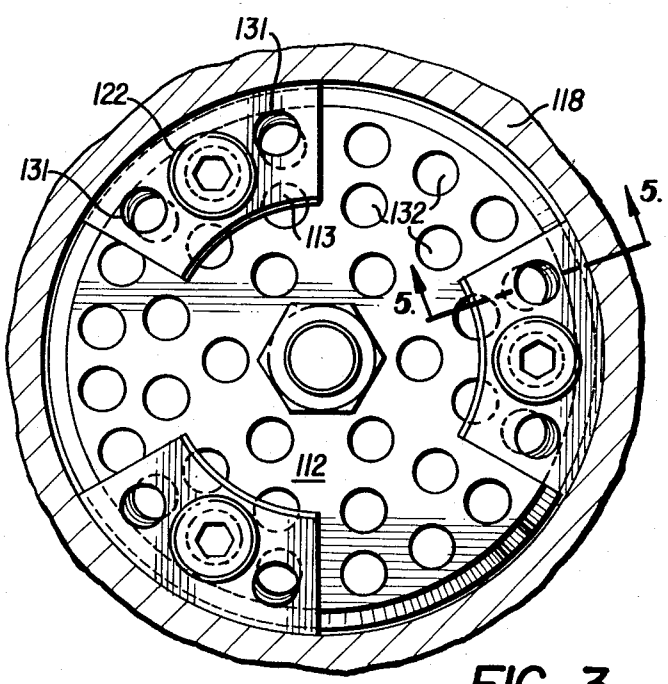
FIG. 3 is a top plan view of the compressor check valve assembly and wedge lock segments of the present invention taken along line 3—3 of FIG. 2.
Figure 4:
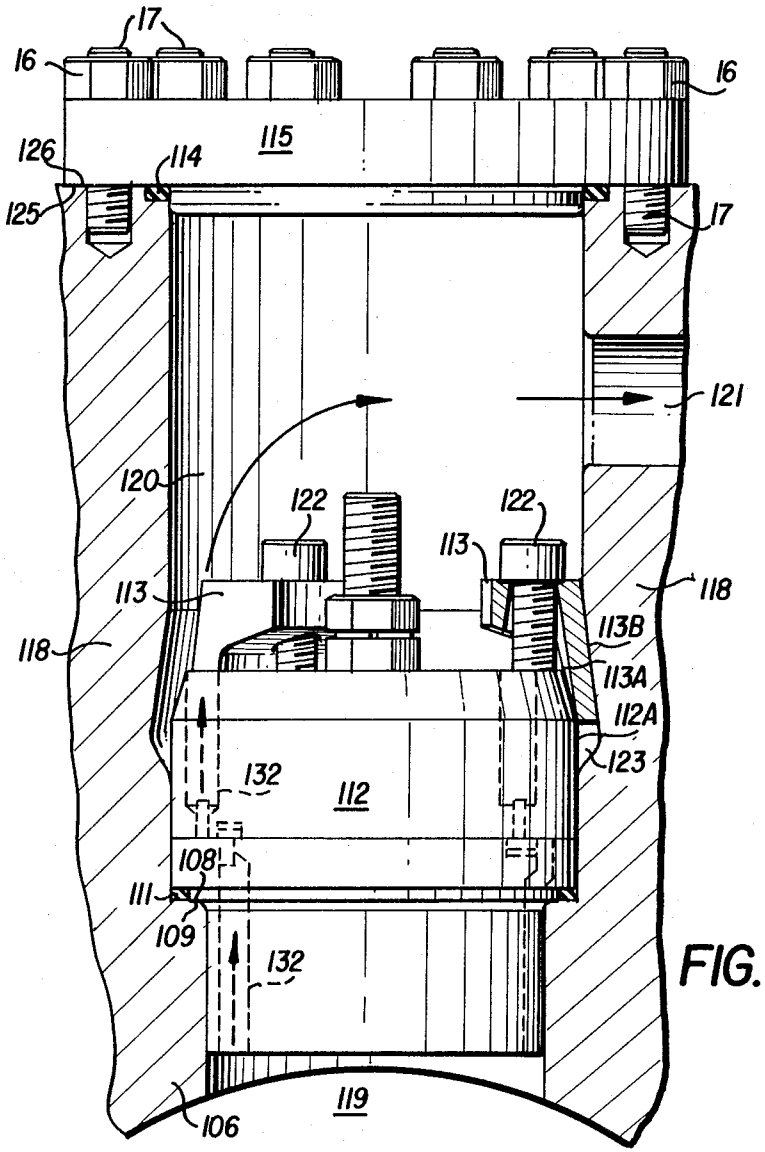
FIG. 4 is a side elevation view of the compressor check valve assembly of the invention, partly in section, showing the wedge lock segments frictionally engaged between the cylinder wall and the check valve assembly.
Figure 2:
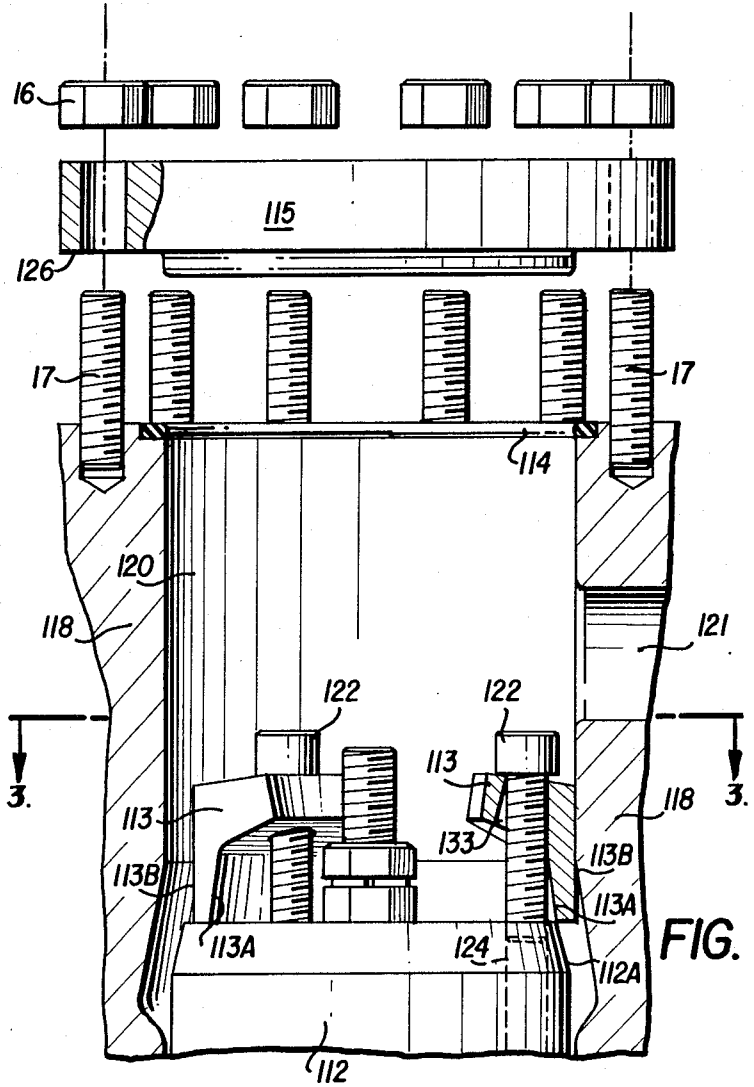
FIG. 2 is a side elevation view of the compressor check valve assembly of the invention, partly in section, showing the cap assembly partly removed from the cylinder, wherein the wedge lock segments are not frictionally engaged.

The solution proposed by the present invention overcomes the prior art cylinder wall stress problems by using wedge lock segments for retaining the valve assembly in place as shown in FIGS. 2-4.

The operation of the compressor check valve assembly 112 will be briefly described by reference to FIG. 4. In cavity 119, a compressor piston (not shown) reciprocates in a horizontal direction. During the discharge stroke, gas is vented through flow bores 132 of the valve assembly 112 and is exhausted through outlet 121 (which is comparable to outlet 22 in FIG. 1). In a manner analogous to the prior art arrangement shown in FIG. 1, the flow path of the gas is shown by arrows.

Before inserting the valve assembly 112 into the cylinder 120, a plurality of wedge segments 113 are loosely attached to the top of the valve assembly 112 with threaded bolts 122 or other types of fasteners (FIG. 2). The bolts 122 are inserted through tapered bores 133 located in each segment 113 and extend into threaded bores 124 located within the valve assembly 112. Preferably, the bolts 122 are hexagonal socket head cap bolts, as may be better seen in the top plan view of the valve assembly 112 shown in FIG. 3. Also, as shown in FIG. 3, it is preferable to use three wedge segments 113 which are equally spaced circumferentially around the periphery of the valve assembly 112.

As shown in FIG. 4, the valve assembly 112 is seated on a valve gasket 111 which is seated on a narrow annular ledge 109. The valve gasket 111 may be a light load type of sealing element comprised of an elastomeric material since the loading forces are less than in the prior art device in which metallic gaskets are used.

In FIGS. 2 and 4, it may be seen that each wedge segment 113 is directed downwardly into a space 123, which is formed between the tapered outer periphery of the check valve assembly 112A and a tapered portion of the wall 118 of the cylinder 120, until each wedge segment 113 has achieved substantially full mating surface contact. It is preferable to use cylinder walls that are tapered slightly, to better grip the outer surface of the wedge segments. However, the present invention can be used even where the cylindrical wall is straight, i.e., non-tapered.

When the cylinder wall 118 is tapered, as shown in FIGS. 2 and 4, it is preferable to use wedge segments 113 having convergently tapered inner 113A and outer 113B surfaces at the portion of the segment that fits between the cylinder wall 118 and the check valve assembly 112. If the cylinder wall is straight, i.e., not tapered, then it is highly preferred to use wedge segments wherein the inner 113A and outer 113B surfaces of the segment are convergently tapered with repect to each other.

As the bolts 122 are torqued down through the tapered bores 133 in the segments 113 into threaded bores 124 located in the valve assembly 112, each wedge segment 113 is driven down between the tapered outer periphery 112A of the check valve assembly and the side wall 118 of the cylinder 120 into the space 123. This in turn forces the valve assembly 112 down into the cylinder 120 until an annular shoulder 108 on the valve assembly 112 is in firm abutment on the ledge 109, thus deforming the valve gasket 111 to a predetermined thickness.

About half the force applied when the bolts 122 are tightened down through the tapered bores 133 is transmitted through the inner surfaces 113A of the wedge shaped segments 113 to the check valve assembly 112 and the other half of the applied force is transmitted through the outer surfaces 113B of the wedge shaped segments 113 to the cylinder wall 118, thus causing a hoop stress in the wall 118 at this plane. However, the force transmitted through the outer surface 113B to the cylinder wall 118 is not excessive for the reason that the midsection of the wall 118 is ideal for absorbing and withstanding hoop stresses due to the massive amount of material at that location, unlike the more critical mass areas adjacent the cavity 19 of the compressor cylinder and adjacent the outermost end of the cylinder.

The bolts 122 acting through the valve assembly 112 do not cause shear stresses sufficient to overstress or crack the wall near the ledge 109, in contradistinction to the prior art, where the bolting forces acting through valve cap 15, cage 13, and valve assembly 12 are large enough to cause shear stresses sufficient to crack the wall near ledge 9. Such reduction of the shear stresses is primarily the result of replacing the vertical bolting forces from the prior art arrangement with the predominantly horizontal forces exerted on the cylinder wall 118 by the wedge segments 113.

Referring again to FIG. 4, a cap gasket 114 is inserted in a counterbore on the inside surface of the cylinder 120. A valve cap 115 is bolted to the wall 118 with studs 17 and nuts 16. A peripheral flange 126 of the cap 115 rests firmly on the gasket 114 and the top surface 125 of the wall 118. Such arrangement differs from the prior art construction shown in FIG. 1 wherein a gap remains between the flange 33 and the top of the cylinder wall 18. As a result, there is no bending moment in the cap 115 of the present invention, which can thus be made thinner with a resultant saving in cost and material. Further, the bolting load or force securing the cap 115 in the present invention will be directed upon a large area of the top surface 125 of the cylinder wall 118, thus causing a compression stress which can be easily absorbed by the wall 118.

Also, because there is no annular chamfer on the cap 115, as in the prior art arrangement, the cap of the present invention does not create any hoop stresses in the cylinder wall adjacent thereto.

Another advantage of the present invention relates to the high stresses caused by the high cyclic pressure created as the compressor piston (not shown) pumps back and forth in the working cavity 19 of the prior art compressor shown in FIG. 1. At corner 6, the material in this transitional area is subjected to both high stresses caused by the high cyclic pressure and the high shear stresses caused by the transmitted bolting forces. However, in the present invention, as shown in FIG. 4, corner 106 is subjected only to the stresses caused by the cyclic pressure in cavity 119 in which the compressor piston (not shown) reciprocates. The corner 106 is not subjected to any substantial transmitted bolting forces because of the relatively great distance from the area where the bolting forces act on the wall 118 in the cylinder.

Figure 5:
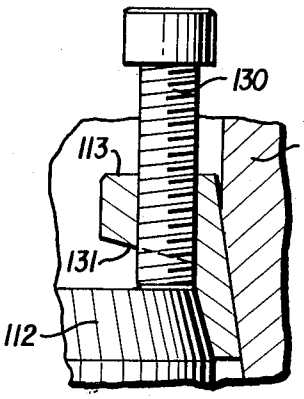
FIG. 5 is a cross-sectional detail view taken along line 5—5 of FIG. 3 showing a jack bolt in a threaded bore for removing a wedge lock segment of the present invention from engagement between the compressor check valve assembly and the wall of the cylinder.

In FIG. 5, there is shown a cross-sectional view taken along line 5—5 of FIG. 3 illustrating a jack bolt 130 engaged in one of two threaded bores 131 in a wedge-shaped segment 113 which retains the valve assembly 112 within the cylinder 120. As best seen in FIG. 3, the threaded bores 131 are parallel to the longitudinal axis of the bolt 122 and are misaligned with the gas flow bores 132 in the valve assembly 112. The wedge segment 113 may thus be retracted from the space 123 by threading two jack bolts 130 into the threaded bores 131 thereby driving the free ends of bolts 130 against the top surface of the valve assembly 112. This is done, of course, only after the bolts 122 are removed from the wedge segment 113 and when it is desired to remove the valve assembly 112 from the cylinder 120.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A device for retaining a valve assembly within a cylinder of a compressor, comprising:

a compressor having a cylinder therein;

a check valve assembly adapted to be disposed in said cylinder;

at least one wedge segment adapted to be disposed between said cylinder and said valve assembly;

means connected to said wedge segment for driving said wedge segment from a disengaged position to a retaining position within said cylinder into frictional engagement with both said valve assembly and said cylinder for assembly and disassembly of said check valve assembly from within said cylinder.

2. The device according to claim 1, wherein said cylinder is provided with an outwardly tapered portion and said valve assembly is provided with a conical portion substantially complementary to the tapered portion of said cylinder and forming an annular space between said tapered and conical portions.

3. The device according to claim 2, wherein a portion of said wedge segment is disposed in said annular space between said tapered and conical portions when said wedge segment is in the retaining position thereof.

4. The device according to claim 1, wherein said valve assembly includes at least one threaded bore in the upper surface thereof and said wedge segment is provided with a through bore adapted to be aligned with said threaded bore, said driving means comprising a bolt extending through said through bore and into threaded engagement with the threaded bore in said valve assembly.

5. The device according to claim 4, wherein said wedge segment is provided with a pair of threaded bores disposed on opposite sides of said through bore, jack bolt means extending through each of the threaded bores of said wedge segment into abutment with said upper surface of the valve assembly for urging said wedge segment from its retaining position to its disengaged position.

6. The device according to claim 4, wherein said wedge segment is provided with at least one threaded bore misaligned with the threaded bore in said valve assembly, whereby said wedge segment is retractable from its retaining position by threading a jack bolt through the threaded bore of said wedge segment and driving the end of said bolt against the upper surface of said check valve assembly.

7. The device according to claim 1, further comprising a cap means for closing said cylinder, said cap means having a peripheral flange bearing directly upon the end surface of said cylinder wall.

8. The device according to claim 7, further comprising an elastomeric gasket seated within an annular recess adjacent the end surface of said cylinder wall, wherein said gasket maintains a seal between said cap and said cylinder wall.

9. The device according to claim 1, wherein an annular ledge is formed within said cylinder, and a shoulder substantially complementary to said ledge is formed on said valve assembly, said shoulder being in firm abutment on said ledge when said check valve assembly is retained within said cylinder.

10. The device according to claim 9, further comprising an elastomeric gasket seated in an annular recess formed in said check valve assembly adjacent said shoulder, wherein said gasket maintains a seal between said ledge and said check valve assembly.

11. The device according to claim 1, including a plurality of wedge segments disposed between said valve assembly and said cylinder in substantially equiangularly spaced relation about the periphery of said valve assembly, said valve assembly having a plurality of threaded bores in the upper surface thereof corresponding to the number of wedge segments, each wedge segment being provided with a through bore adapted to be aligned with a respective threaded bore, said driving means comprising a bolt extending through each through bore and into threaded engagement with the threaded bore aligned therewith.

12. The device according to claim 3, wherein said portion of said wedge segment has convergently tapered inner and outer surfaces.

13. A device for retaining a valve assembly within a cylinder, comprising:

a plurality of wedge segments, each of said segments adapted to be disposed between said cylinder and said valve assembly, each segment containing a tapered bore therethrough; and fastener means extending through the tapered bore of each wedge segment and engaging with the check valve assembly for driving the wedge segments into frictional engagement between the valve assembly and the cylinder within the cylinder, thereby retaining the valve assembly within the cylinder.

14. The device according to claim 13, wherein said cylinder is provided with an outwardly tapered portion and said valve assembly is provided with a conical portion substantially complementary to the tapered portion of said cylinder and forming an annular space between said tapered and conical portions.

15. The device according to claim 14, wherein a portion of each of said wedge segments is disposed in said annular space between said tapered and conical portions when said wedge segments are in the retaining position thereof.

16. The device according to claim 13, wherein said valve assembly includes a plurality of threaded bores in the upper surface thereof aligned with said tapered bores such that said fastener means engage in said threaded bores.

17. The device according to claim 13, further comprising an elastomeric gasket seated within an annular recess adjacent the end surface of said cylinder wall, and a cap means for closing said cylinder, said cap means having a peripheral flange bearing directly upon the end surface of said cylinder wall, wherein said gasket maintains a seal between said cap and cylinder wall.

18. The device according to claim 13, wherein an annular ledge is formed within said cylinder, and a shoulder substantially complementary to said ledge is formed on said valve assembly, said shoulder being in firm abutment on said ledge when said check valve assembly is retained within said cylinder.

19. The device according to claim 18, further comprising an elastomeric gasket seated in an annular recess formed in said check valve assembly adjacent said shoulder, wherein said gasket maintains a seal between said ledge and said check valve assembly.

20. The device according to claim 13, wherein said wedge segments are each provided with at least one threaded bore being intentionally misaligned with all bores in said valve assembly, wherein each wedge segment may be retracted from its retaining position by threading a bolt through the threaded bores of said wedge segment and driving the end of said bolt against the surface of said check valve assembly.

21. A method for retaining a compressor check valve assembly within a compressor cylinder using wedge segments, comprising the steps of:

locating the check valve assembly from within the cylinder;

disposing wedge segments between the check valve assembly and the cylinder; and driving said wedge segments into frictional engagement with said check valve assembly and cylinder for retaining the check valve assembly within the cylinder.

* * * * *